US007382222B1

(12) United States Patent
Manetakis

(10) Patent No.: US 7,382,222 B1
(45) Date of Patent: Jun. 3, 2008

(54) MONOLITHIC INDUCTOR FOR AN RF INTEGRATED CIRCUIT

(75) Inventor: Konstantinos Manetakis, Caen (FR)

(73) Assignee: Silicon Laboratories Inc., Austin, TX (US)

( * ) Notice: Subject to any disclaimer, the term of this patent is extended or adjusted under 35 U.S.C. 154(b) by 0 days.

(21) Appl. No.: 11/617,969

(22) Filed: Dec. 29, 2006

(51) Int. Cl.
*H01F 5/00* (2006.01)

(52) U.S. Cl. ..... 336/200

(58) Field of Classification Search ..... 336/65, 336/83, 200, 206–208, 232; 257/531
See application file for complete search history.

(56) References Cited

U.S. PATENT DOCUMENTS 4,816,784 A * 3/1989 Rabjohn ..... 333/24 R
6,580,334 B2 * 6/2003 Simburger et al. ..... 333/24 R
6,608,364 B2 * 8/2003 Carpentier ..... 257/531
7,039,381 B2 * 5/2006 Yang et al. ..... 455/292
7,088,214 B2 * 8/2006 Castaneda et al. ..... 336/200
7,095,307 B1 * 8/2006 Barrett et al. ..... 336/200
7,253,712 B1 * 8/2007 Papananos ..... 336/200

* cited by examiner

*Primary Examiner*—Tuyen Nguyen
(74) *Attorney, Agent, or Firm*—Howison & Arnott, L.L.P.

(57) ABSTRACT

An integrated high frequency inductor is disclosed that includes first and second conductor loops. The first conductor loop is fabricated in a conductive layer of a semiconductor substrate and having a first substantially constant width. The second conductor loop is fabricated in the conductive layer and within the boundary of the first conductor loop and having a second substantially constant width less than the first substantially constant width, and the outer perimeter of the second conductor loop separated from the inner perimeter of the first conductor loop by a substantially constant gap. A first conductor bridge connects a first end of the first conductor loop to a first end of the second conductor loop. A second conductor bridge is provided for connecting a fourth end of the first conductor loop to a second end of the second conductor loop, the first and second conductor bridges operable to form a single conductive loop between the first and second ends of the first conductor loop, the single conductive loop comprised of the first conductor loop, the second conductor loop, the first conductor bridge and the second conductor bridge.

8 Claims, 5 Drawing Sheets

MONOLITHIC INDUCTOR FOR AN RF INTEGRATED CIRCUIT

TECHNICAL FIELD OF THE INVENTION

The present invention pertains in general to inductors and, more particularly, an inductor formed on the surface of a semi-conductor substrate.

BACKGROUND OF THE INVENTION

In high frequency RF circuits, there are required a plurality of components, some components being active components and some being passive components. The passive components are comprised of reactive and passive components. The reactive components typically are comprised of capacitors and inductors whereas the passive components are typically resistors. However, when operating at high frequencies, the concept of "impedance" is utilized, which impedance typically is comprised of distributed inductance, distributed capacitance and distributed resistance. A simple conductor or line at DC will only have a resistive component. However, at high frequencies, there will be a series inductance associated with that line as well as a distributed capacitance between the line and any other conductor, the dielectric constant of the capacitor being the medium on which the line is formed.

One of the primary components in an RF circuit is an inductor, and one of the more difficult to fabricate. An ideal inductor at low frequencies is comprised of a coil that is either wound around a magnetic core or it is merely fabricated with a plurality of "turns" with the core being air. There will always be an inherent series resistance due to the wire utilized and, when wound about a core, there will be some magnetic loss in the core. Typically, if the inductor is freestanding, there will be very little capacitance coupling between the coil wire and adjacent bodies or conductors. Thus, the primary components of the inductor will be the series resistance and the number of turns of that inductor and the overall length of the wire used in the inductor. The resistance of the inductor has a direct correlation to the loss associated with that inductor. Of course, thicker wire can be utilized to reduce series resistance. However, this series resistance and/or the winding of the coil on the magnetic core, results in a decrease in "quality factor" or, as it is more commonly referred, the "Q," especially at high frequencies. This Q-factor is a measure of the quality of the coil. If one wants to have a very sharp resonant circuit, it is desirable to have a very high Q-factor. This Q-factor directly relates to the loss of the coil. Thus, in high frequency circuits, it is desirable to have a very low loss coil, i.e., there should be minimal series resistance and there should be minimal capacitance between the turns of the coil and any adjacent conductors. Further, the medium that is disposed between turns of the coil should be, in the ideal, air.

In the first high frequency circuits, it was possible to fabricate the inductors as discrete components that could be soldered onto a circuit board. It was then possible to fabricate these coils around a very low loss core and utilize fairly low loss wire, resulting in a very high-Q coil with sufficient inductance. However, this was an expensive solution and it was desirable to fabricate the coils, if possible, on the substrate such that a resultant monolithic solution was achieved. Some of the first monolithic coils were those formed on thin film substrates such as quartz substrates. These coils typically took the form of a helical line pattern disposed on the quartz substrate beginning from a center point and spiraling outward therefrom to comprise the two terminals of coil. This resulted in fairly high Q-factor coils due to the fact that the dielectric constant of the quartz was fairly low. However, the size of the inductor was still restricted due to the amount of surface area required for the coil. If the line width was reduced, the series resistance went up and the Q-factor of the coil went down. Thus, these type of coils were limited to matching elements and, possibly, utilized for RF "chokes" which were required between a transistor terminal and a bias input. These chokes presented a high impedance to the circuit over a fairly narrow band frequencies, typically the operating band. Integrated circuits have seen a dramatic increase in speed thereof, resulting in the ability to fabricate integrated circuits operating upwards of 2-3 GHz. The need for monolithic matching elements, such as inductors and capacitors of high quality, has thus also increased. However, the problem with any type of inductor or capacitor is that it requires a certain amount of space, i.e., silicon surface area. Typically, there is the defined amount of surface area required for the inductor itself which is typically formed on one or two layers of the substrate structure with a "guard band" disposed thereabout to prevent unwanted coupling to other circuits. Typically, some type of ground plane or the such is required to be disposed between one RF component and another. The problem with these types of monolithic structures on a semi-conductor substrate is that they are typically fabricated on silicon dioxide. Thus, it is necessary to insure that the capacitance between any conductor in one of these reactive elements is minimized with respect to other conductors and that the series resistance is minimized. This series resistance is a function of the type of material from which the inductor is fabricated. Typically, these inductors will be fabricated in one or more of the metal layers, which metal is typically comprised of copper. Thus, any changes that can be made to an inductor to decrease the amount of space required for that inductor will be a desirable aspect of a monolithic RF inductor, as it will save valuable silicon real estate.

SUMMARY OF THE INVENTION

The present invention disclosed and claimed herein, in one aspect thereof, comprises an integrated high frequency inductor that includes first and second conductor loops. The first conductor loop is fabricated in a conductive layer of a semiconductor substrate and having a first substantially constant width, the first conductor loop having a first break therein to form first and second ends and a second break therein to form third and fourth ends, the first and second ends able to be interfaced to external nodes comprising two opposite ends of the inductor. The second conductor loop is fabricated in the conductive layer and within the boundary of the first conductor loop and having a second substantially constant width less than the first substantially constant width, and the outer perimeter of the second conductor loop separated from the inner perimeter of the first conductor loop by a substantially constant gap, the second conductor loop having a first break therein to form first and second ends. A first conductor bridge connects the first end of the first conductor loop to the first end of the second conductor loop. A second conductor bridge is provided for connecting the fourth end of the first conductor loop to the second end of the second conductor loop, the first and second conductor bridges operable to form a single conductive loop between the first and second ends of the first conductor loop, the single conductive loop comprised of the first conductor loop, the second conductor loop, the first conductor bridge and the second conductor bridge.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
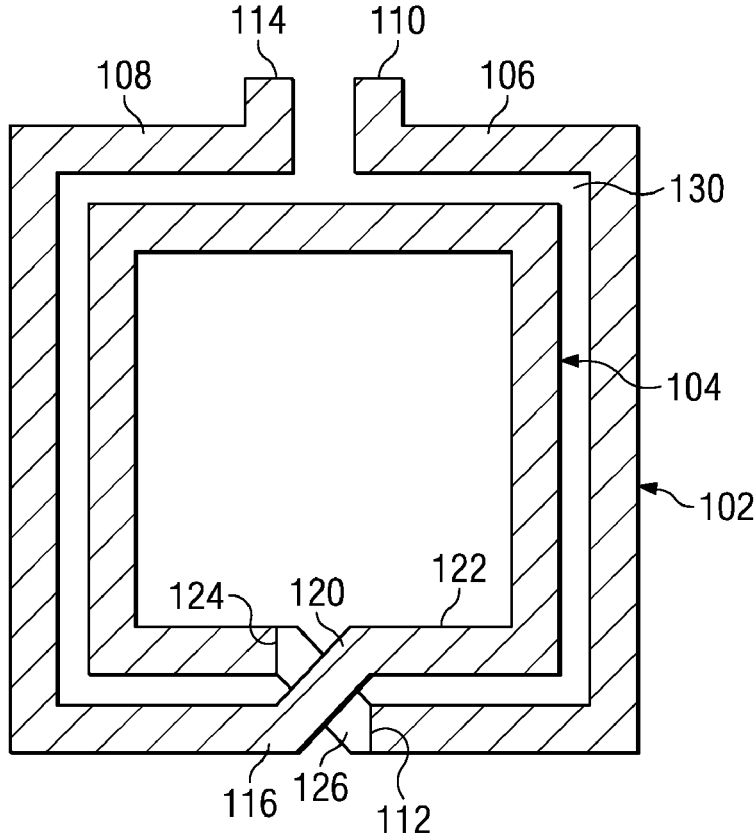
FIG. 1 (PRIOR ART)
FIG. 1 illustrates a prior art monolithic RF inductor.

Referring now to the drawings, wherein like reference numbers are used herein to designate like elements throughout the various views, embodiments of the present invention are illustrated and described, and other possible embodiments of the present invention are described. The figures are not necessarily drawn to scale, and in some instances the drawings have been exaggerated and/or simplified in places for illustrative purposes only. One of ordinary skill in the art will appreciate the many possible applications and variations of the present invention based on the following examples of possible embodiments of the present invention.

Referring now to FIG. 1, there is illustrated a prior art monolithic RF inductor. This inductor is comprised of two turns, a first outer turn 102 and an inner turn 104. The outer turn is comprised of two sections, a first section 106 and a second section 108. The section 106 extends from a terminal 110 to a first terminating end 112 on one surface of the substrate. The second half of the outer turn 102, the section 108, extends from a terminal 114 to a terminus 116 on the substrate. Since both turns 102 and 104 are formed on one surface, there must be some type of "jumper." The second section 108 is connected to the inner turn 104 via a shunt 120 on the same layer of the substrate as the turn 102 and the turn 104. It connects to a terminus 122 of the inner turn 104, this extending around the inner turn 104 to a terminus 124. The terminus 124 is operable to be connected to the terminus 112. However, this is connected at a different layer with a shunt 126. The typical fabrication is to utilize a metal layer at one of the lower layers of metal and provide vias through the one layer to a lower metal layer and pattern that lower metal layer to provide the shunt 126 for connection thereto.

The conformation of the inductor is a square inductor, although it should be understood that a circular inductor could be utilized; however, the circular inductor would require more surface area than the square inductor. As such, the square or rectangular shape inductor is the preferred confirmation. However, any other confirmation could be utilized.

The outer turn 102 and the inner turn 104 are configured such that they are separated by a gap 130 of substantially constant width. In this embodiment, the width of the turn 102 and the width of the turn 104 is the same, and the gap 130 is substantially constant between the two inductors. Therefore, since they are two turns in a given coil (in this exemplary embodiment, although there could be more turns) and since the orientation is not reversed, the currents flowing through the outer turn 102 and the inner turn 104 are in the same direction. This will provide inductive coupling between the turns resulting in the inductive value thereof.

In addition to the inductive value, the Q, or Quality factor, of the inductor is important. The Q-factor is a ratio of the reactance (X) of the inductor at a given frequency (f) to its DC resistance. The reactance of the inductor of value L is equal to $2\pi fL$. The quality factor is affected by such things as parasitic capacitance, coupling from other circuitry, etc. Therefore, it is important to maximize the design such that the series resistance of the inductor is minimized to decrease the DC resistance. Further, varying of the gap between the inductors can affect the size, but it also affects the inductance and it affects the quality factor. All of these must be considered. As will be described herein below, once a particular gap width and dimension is determined for a given inductance, the techniques employed and described herein below will decrease the size while maintaining the inductance and the quality factor substantially the same.

Figure 2:
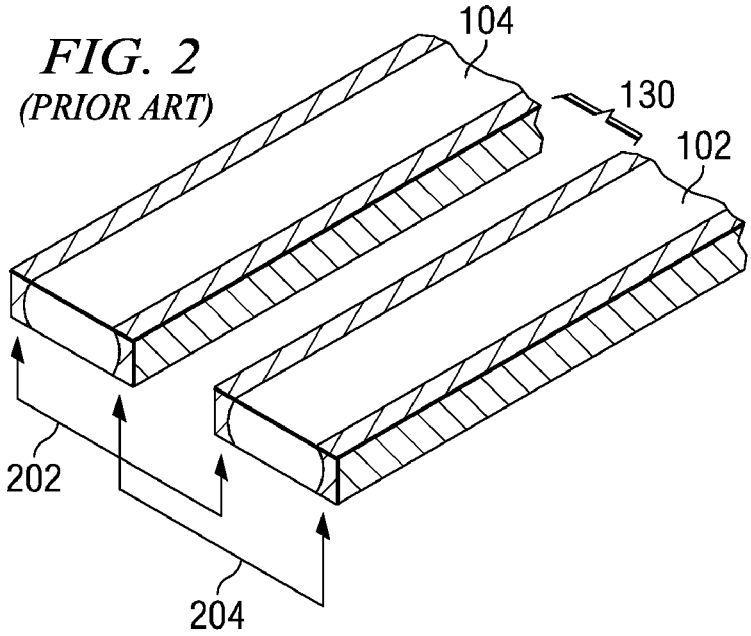
FIG. 2 (PRIOR ART)
FIG. 2 illustrates a sectional view of two adjacent turns of the inductor of FIG. 1.

Referring now to FIG. 2, there is illustrated a cross-sectional view of two adjacent turns 102 and 104. As noted herein above, the widths of both of these conductors is substantially the same and they are formed on a common metal layer. However, as will be described herein below, they could be formed on different layers. In this depiction, at a high frequency, what happens is that the current is not evenly distributed and the current is actually concentrated at the edges. This results in an inductive effect between the two edges on either side of the two conductors. There is a first inductance 202 between the two left edges and a second inductance 204 between the two right edges, and one between the two closest edges by the gap 130. It can be seen that, since the left edge of conductor 104, for example, is disposed from the left edge of the conductor 102, this will result in a separation of the actual two currents. This actually results in an increase in the inductance over what would be expected if the current were evenly distributed along the conductor.

Figure 3:
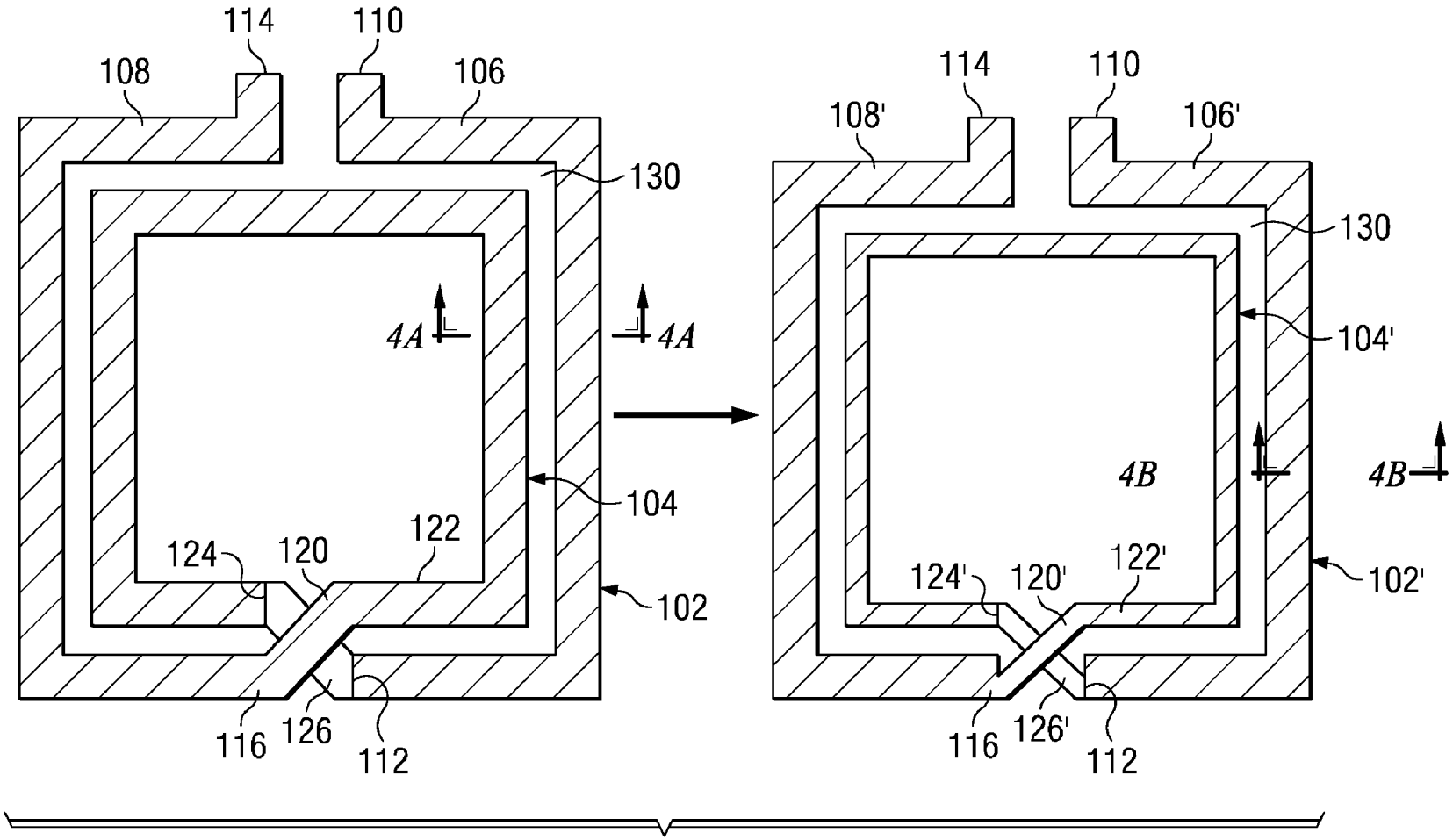
FIG. 3 illustrates a diagrammatic view of the reduction in surface area for the disclosed embodiment of the present invention.

Referring now to FIG. 3, there is illustrated an embodiment illustrating the reduction in size. The inductor on the left is basically the inductor of FIG. 1 with like numerals referring to like components in the two figures. The inductor on the right side of FIG. 3 is the reduced structure with substantially the same inductance and Q-factor. This design has the object of achieving a maximum inductance value (L) and quality factor (Q) while minimizing the area consumed.

This is achieved by designing the two turns with different widths. Of course, reducing the width of a conductor in one of the turns thereof increases the series resistance and, as such, has a tendency to decrease the Q-factor. The design technique utilizes the inductor on the left as the baseline as to a baseline inductance value and a baseline Q-factor, and then the width of the inner turn is reduce, thus bringing the two conductors "effectively" closer together without changing the gap, due to the fact that the edge currents are closer together. This has the effect of increasing the inductance. Since the inductance increases, the length of the overall coils can be decreased. This, of course, will result in a decrease in Q-factor due to the two turns being closer and the higher resistance in the thinner conductor for the inner turn. This is compensated for by reducing the turn perimeter. This reduces the inductor area and keeps the inductance value substantially constant. It can be seen that all of the structure is substantially the same with the exception that the inner turn 104 is reduced in width and results in an inner turn 104' with an adjoining section 126' and 120' and terminus 122' and 124'. Since the sections 106 and 108 are reduced in length, they are referred to as sections 106' and 108'.

Figure 4A:
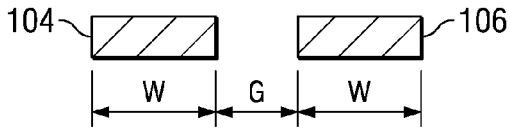
FIG. 4*a* illustrates a cross-sectional view of two adjacent turns of the prior art side of FIG. 3.
Figure 4B:
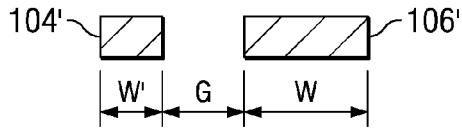
FIG. 4*b* illustrates a cross-sectional view of two adjacent turns in the disclosed RF inductor.

Referring now to FIG. 4*a*, there is illustrated a cross-sectional view of the two adjacent turns in FIG. 3. It can be seen that both of the widths are substantially the same. In FIG. 4*b*, there is illustrated a cross-sectional view of two adjacent turns 102' and 104', wherein the width of the conductor on the inner turn 104' is reduced. This has the effect of bringing the left edge of a conductor in inner turn 104' closer to the conductor in the section 106', that section 106' being substantially the same as the embodiment of FIG. 4*a*. The gap is set to the same width.

Figure 5:
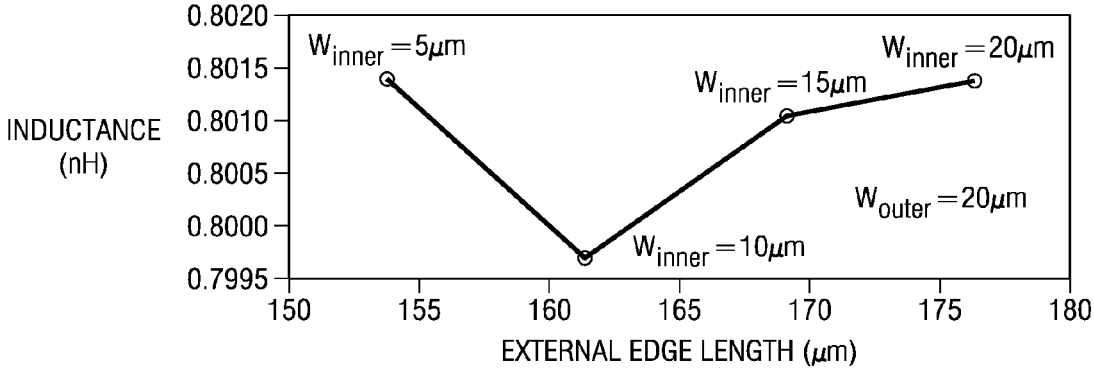
FIG. 5 illustrates a plot of inductance versus the external edge length in any normalized inductor FIG. 3.
Figure 6:
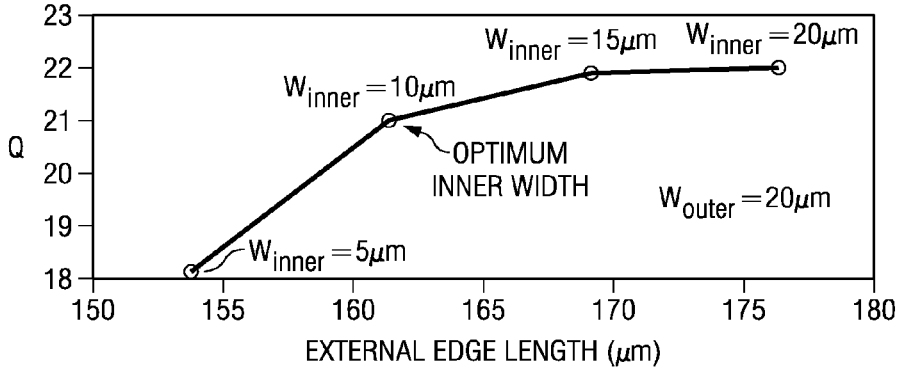
FIG. 6 illustrates a plot for the external edge length as a function of Q-factor.
Figure 7:
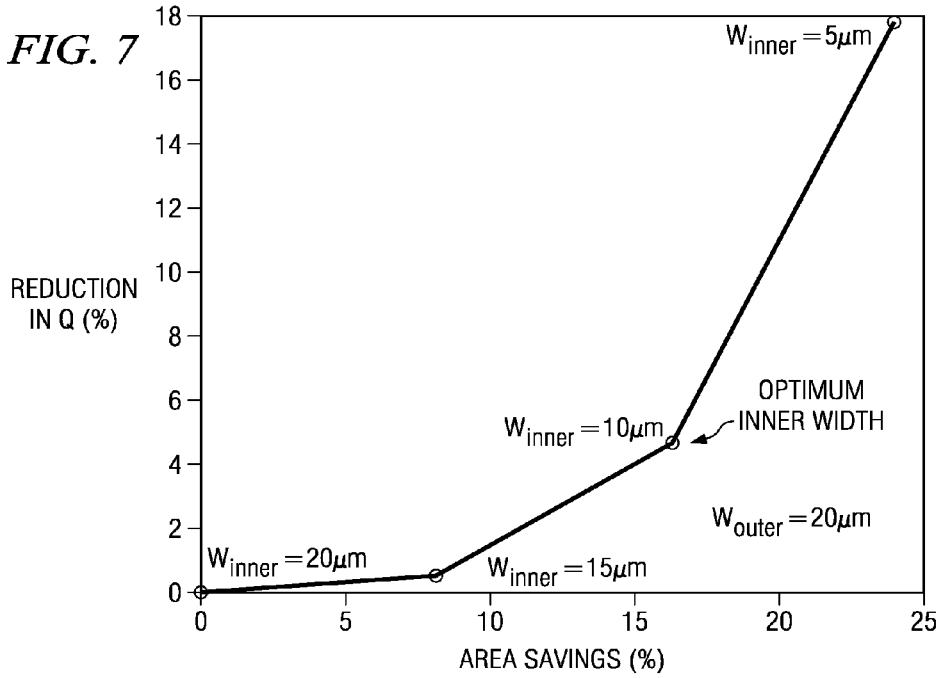
FIG. 7 illustrates the plot of the reduction in the Q-factor as a function of the area savings in percent.

Referring now to FIGS. 5, 6, and 7, there are illustrated plots of a simulation as to how the method works and the criteria associated therewith. For this example, the inductor that is utilized in the non-reduced size has a side length of 175 μm and this is reduced to where the length of the side is 160 μm. The original width of the outer and the inner turns is equal to 20 μm. The reduced inductor has a width of 20 μm for the outer turn and a reduced width of 10 μm for the inner turn 104'. Both inductors have an inductance L=0.8 nH. The non reduced inductor achieves a Q=22 with an area of 30600 $\mu m^2$, while the second and reduced inductors achieves a Q=21 with an area 25600 $\mu m^2$. This represents an approximately 17% area reduction with less than 5% reduction in Q.

In FIG. 5, there is illustrated a chart that shows the inductance and Q of a two turn inductor. The outer turn 102' has a width equal to 20 μm wherein the inner turn 104' has a width as varied from 5 μm to 20 μm with steps of 5 μm. The turn separation is kept constant at 10 μm. It can be seen that as the width changes, the inductance decreases to a minimum at a width of 10 μm and then increases at a width of 5 μm. FIG. 6 illustrates the variation of Q as a function of external edge length, keeping the premise that the inductance stays substantially the same and the gap width stays approximately the same. Thus, what is necessary is that for any width, the length of the inductor or the edge length is adjusted to get the inductance approximately the same. For example, in FIG. 5, the length for the 20 μm for an inductance of 0.800 nH is approximately 175 μm. This length must be reduced to approximately 170 μm for a width on the inner loop of 15 μm and to a length of approximately 160 μm for a width of 10 μm. The Q for these lengths and the resultant inductor are illustrated in FIG. 6. FIG. 7 illustrates the reduction in Q of length, keeping the inductance approximately the same. It can be seen that very little effect to the Q-factor occurs between 20 μm to 15 μm. For 10 μm, there is very little reduction in Q and it can be seen that the area savings is approximately 15%. However, for a width of 5 μm and the same inductance, the Q decreases by approximately 18%, in spite of the fact that the area savings is close to 25%. Thus, the optimum width is approximately 10 μm. for this particular example.

Figure 8:
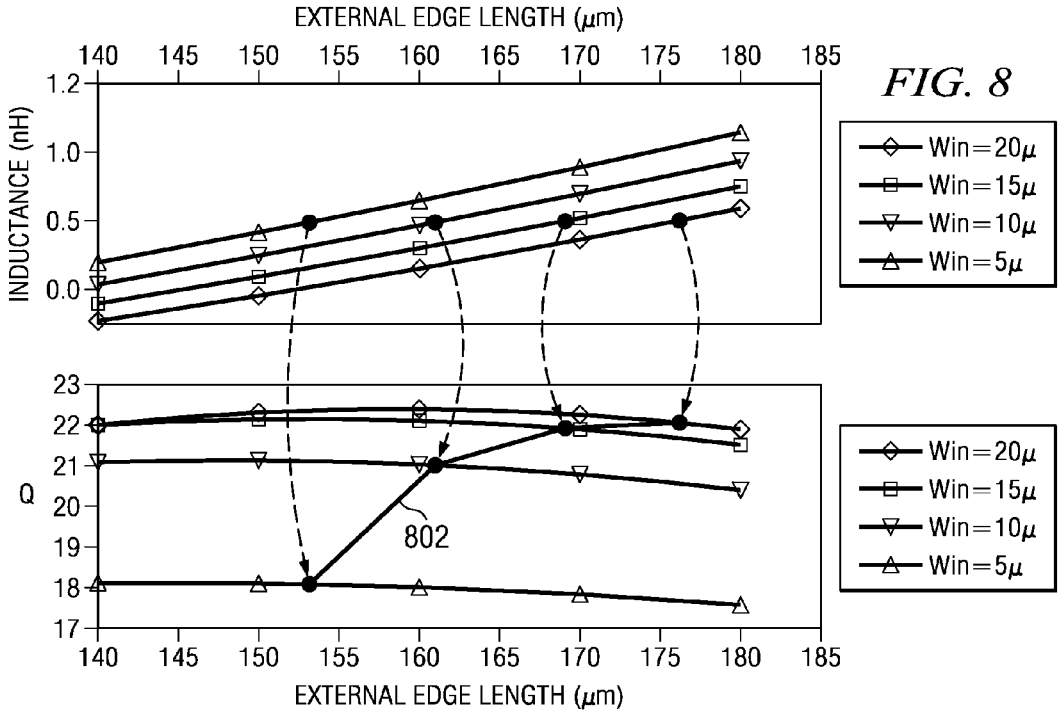
FIG. 8 illustrates a combined plot for the plots of FIGS. 5-7.

Referring now to FIG. 8, there is illustrated an alternate way of looking at the particular method of reducing the size. In FIG. 8, at the top portion thereof, the inductance as a function of external age length is illustrated, keeping the premise that the inductance is kept substantially at 0.8 nH. In this plot, there is illustrated the external edge length for each width variation keeping the inductance approximately the same. It can be seen that there is a slight slope to the pattern. The bottom graph illustrates the Q-factor as a function of the external edge length for each width. For an inductance of 0.8 nH for each width, the plot of Q-factor is formed with a curve 802. It can be seen that the Q at a width of 20 μm of 22 is reduced to a Q of approximately 21 at a width of 10 μm.

Figure 9:
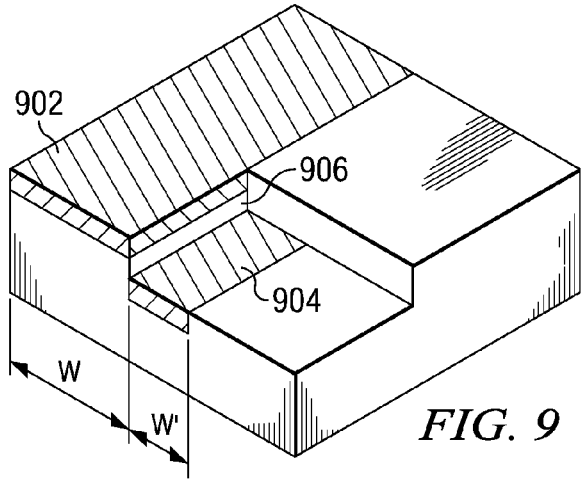
FIG. 9 illustrates a perspective view of an alternate embodiment.
Figure 9A:
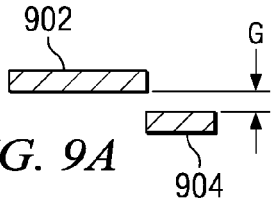
FIG. 9*a* illustrates a cross-sectional view of two adjacent turns of the embodiment of FIG. 9.

Referring now to FIG. 9, there is illustrated an alternate embodiment wherein the two turns 102' and 104' are disposed on different levels. This is illustrated as a conductor 902 on an upper surface of a width W and a conductor 904 on a different layer of the semiconductor substrate with a width of W', a narrower inductor. These are offset such that they are "non-overlapping." They are separated by a layer of insulating material 906, such as silicon dioxide. This is a conventional insulating material. The gap that they are separated by is illustrated in FIG. 9*a* in which it can be seen that the gap is the vertical distance. However, it should be understood that the gap can be a function of the vertical distance and also of the overlap. There could be overlapping or an offset in the lateral plane.

Figure 10:
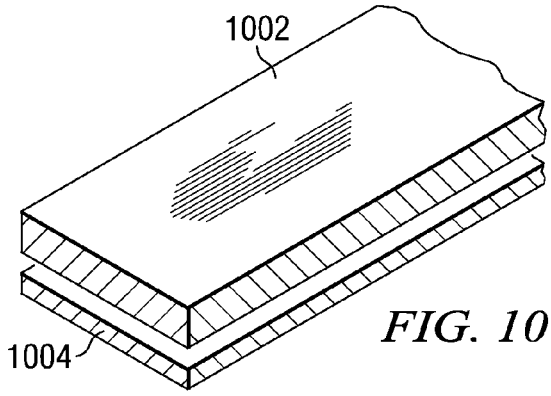
FIG. 10 illustrates a third embodiment of the present disclosure in perspective.
Figure 10A:
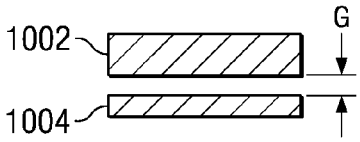
FIG. 10*a* illustrates a cross-sectional view of the embodiment of FIG. 10.

Referring now to FIGS. 10 and 10*a*, there is illustrated an alternate embodiment. In FIG. 10, there is illustrated an embodiment wherein the two turns 102' and 104' are disposed over top of one another. Therefore, there will be a conductor 1002 formed on one layer of the semiconductor substrate separated by an insulating layer (not shown). Underlying the conductor 1002 is a second conductor 1004 that is substantially the same width as the conductor 1002 (but could be a different width also) but with a thinner metal layer. This is operating on the same principal as described above with respect to FIG. 2 in that the purpose is to move the most distant side of one conductor closer to the other. This will result in basically a thinner middle layer as opposed to reduced dimensions, but it will operate on substantially the same principal. The gap is illustrated in FIG. 10*a*.

It will be appreciated by those skilled in the art having the benefit of this disclosure that this invention provides a reduced high frequency inductor. It should be understood that the drawings and detailed description herein are to be regarded in an illustrative rather than a restrictive manner, and are not intended to limit the invention to the particular forms and examples disclosed. On the contrary, the invention includes any further modifications, changes, rearrangements, substitutions, alternatives, design choices, and embodiments apparent to those of ordinary skill in the art, without departing from the spirit and scope of this invention, as defined by the following claims. Thus, it is intended that the following claims be interpreted to embrace all such further modifications, changes, rearrangements, substitutions, alternatives, design choices, and embodiments.

What is claimed is:

1. An integrated high frequency inductor, comprising:

a first conductor loop fabricated in a conductive layer of a semiconductor substrate and having a first substantially constant width, said first conductor loop having a first break therein to form first and second ends and a second break therein to form third and fourth ends, said first and second ends able to be interfaced to external nodes comprising two opposite ends of the inductor;

a second conductor loop fabricated in said conductive layer and within the boundary of said first conductor loop and having a second substantially constant width less than said first substantially constant width, and the outer perimeter of said second conductor loop separated from the inner perimeter of said first conductor loop by a substantially constant gap, said second conductor loop having a first break therein to form first and second ends;

a first conductor bridge for connecting the first end of said first conductor loop to the first end of said second conductor loop; and a second conductor bridge for connecting said fourth end of said first conductor loop to the second end of said second conductor loop, said first and second conductor bridges operable to form a single conductive loop between said first and second ends of said first conductor loop to carry current in a first direction within said first conductor loop and said second conductor loop such that current flowing through one of said first or second conductor loops is parallel in direction to the substantially same current flowing through the other thereof, said single conductive loop comprised of said first conductor loop, said second conductor loop, said first conductor bridge and said second conductor bridge, and wherein said first and second substantially constant widths and the length of said first conductor loop and said conductor loop are optimized for inductance value and quality factor.

2. The inductor of claim 1 wherein said first and second conductor loops are fabricated of metal.

3. The inductor of claim 1 wherein said first conductor bridge is formed in the same conductive layer as said first conductor loop and said second conductor loop.

4. The inductor of claim 3, wherein said second conductive bridge is formed in a conductor layer that is disposed adjacent said conductive layer in which said first and second conductor loops are formed and separated therefrom by a dielectric layer, with the ends of said second conductor bridge connected through said dielectric layer to said fourth end of said first conductor loop and said second conductor loop.

5. The inductor of claim 1 wherein said first conductor loop and said second conductor loop have rectangular configurations.

6. The inductor of claim 1 wherein said first conductor loop and said second conductor loops have a substantially square configuration.

7. The inductor of claim 1, wherein said first width of said first substantially constant width and second substantially constant width are related such that said second substantially constant width is between twenty-five percent (25%) and seventy-five percent (75%) of said first substantially constant width.

8. The inductor of claim 7, wherein said second substantially constant width has a width that is approximately fifty percent (50%) of said first substantially constant width.

* * * * *